US005615712A

United States Patent [19]

Derudder et al.

[11] Patent Number: 5,615,712

[45] Date of Patent: Apr. 1, 1997

[54] TECHNIQUE FOR SEPARATING AND TENSIONING WARP THREADS IN A FACE-TO-FACE WEAVING MACHINE

[75] Inventors: Carlos Derudder, Heule; Johnny Debaes, Wenduine, both of Belgium

[73] Assignee: N.V. Michel Van De Wiele, Marke, Belgium

[21] Appl. No.: 402,015

[22] Filed: Mar. 10, 1995

[30] Foreign Application Priority Data

Mar. 11, 1994 [BE] Belgium ..... 09400273

[51] Int. Cl.[6] ..... D03D 39/16; D03D 49/22

[52] U.S. Cl. ..... 139/21

[58] Field of Search ..... 139/21, 43, 37, 139/97

[56] References Cited

U.S. PATENT DOCUMENTS 3,394,739 7/1968 Crenshaw et al. ..... 139/21
4,176,692 12/1979 Simmons, Jr. ..... 139/21

FOREIGN PATENT DOCUMENTS 1517226 2/1968 France .

*Primary Examiner*—Andy Falik
*Attorney, Agent, or Firm*—Brumbaugh, Graves, Donohue & Raymond

[57] ABSTRACT

A device is provided for separating and tensioning warp threads in a face-to-face weaving machine of the type used for weaving at least a first fabric and a second fabric that are linked to each other, the first fabric including at least a plurality of first binding warp threads and first tension warp threads and the second fabric including at least a plurality of second binding warp threads and second tension warp threads. The device comprises a first set of rollers for separating the first binding warp threads from the first tension warp threads, a second set of rollers for causing the separated first binding warp threads to cross each other between the rollers in the second set, a third set of rollers, structurally similar to the first set, for separating the second binding warp threads from the second tension warp threads, and a fourth set of rollers, structurally similar to the second set, for causing the separated second binding warp threads to cross each other between the rollers in the fourth set. The first binding warp threads in the first fabric attain substantially the same tension as the second binding warp threads in the second fabric.

7 Claims, 4 Drawing Sheets

TECHNIQUE FOR SEPARATING AND TENSIONING WARP THREADS IN A FACE-TO-FACE WEAVING MACHINE

FIELD OF THE INVENTION

The invention relates to a thread separating and tensioning device for a face-to-face weaving machine, in particular for a carpet and velvet weaving machine.

BACKGROUND OF THE INVENTION

In the case of a triple gripper weaving machine for carpet or velvet it is expedient first to insert one weft thread in the top fabric and two weft threads in the bottom fabric simultaneously, and then to insert two weft threads in the top fabric and one weft thread in the bottom fabric. This is the case if one wishes to achieve the three-shot weave in two working cycles or two runs of the weaving machine. For a known two-shot weave it is expedient, for example, first to insert no weft thread at all in the top fabric and two weft threads in the bottom fabric simultaneously, and then to insert two weft threads in the top fabric and no weft thread in the bottom fabric. In this process the top or bottom weft insertion device is switched off in each case.

In this known process, for a first shot the shed with ground warp thread course is presented for single or no insertion in the top fabric and double insertion in the bottom fabric, and for a second shot the ground warp thread course is presented for double weft insertion in the top fabric and single or no weft insertion in the bottom fabric.

From this presentation of the warp thread course for both cases it can be deduced that the binding warp for a first shot, for example, has to form a small shed opening for one gripper, and for the second shot a large or double shed opening for two grippers. Moreover, the bisector of these small and large shed openings does not coincide, so that this known separating roller arrangement is not sufficient to bring binding warp thread layers to the same tension. One layer becomes tensioned, the other becomes slack, in such a way that weaving becomes impossible.

For the top fabric the bisector plane of the binding warp thread planes runs from fabric edge until it makes contact above the top separating roller for a first shot cycle. For the top fabric the bisector plane of the binding warp thread planes runs from the fabric edge until it is far below the first separating roller for the second shot. For the bottom fabric a similar arrangement can be made.

SUMMARY OF THE INVENTION

The invention is directed to a device for obtaining virtually the same binding warp thread tension, preferably the same, in the top and bottom binding warp thread layer.

The device according to the invention contains per top or first fabric, in addition to a first set of separating rollers, a second set of separating rollers between which the binding warp threads cross each other.

The second set of separating rollers for the first fabric is preferably mounted on a system which is rotatable relative to a holder bearing the first set of separating rollers for the first fabric.

The device contains per bottom or second fabric, in addition to a third set of separating rollers, a fourth set of separating rollers between which the binding warp threads cross each other.

The fourth set of separating rollers for the second fabric is preferably mounted on a system which is rotatable relative to a holder bearing the third set of separating rollers for the second fabric.

For example, for the first fabric and the second fabric which are being woven the two sets of separating rollers for the first fabric and the second fabric are mounted on separate systems; the second set of separating rollers for the first fabric being rotatable relative to a holder of the first set of separating rollers of binding warp threads of the first fabric, and the third set of separating rollers for the second fabric being rotatable relative to a holder of the fourth set of separating rollers of binding warp threads of the second fabric.

According to one embodiment, the device for a fabric comprises an element which is rotatable relative to the first set of separating rollers, about an axis extending between the two rollers in the second set, preferably in the center point between said two rollers.

According to another embodiment, the device for a fabric comprises an element which bears the second set of separating rollers for the binding warp threads of the fabric, and an arm on which the element is mounted so that it is rotatable relative to the holder of the first set of separating rollers.

The arm is mounted so that it can swivel on the holder, which is mounted adjustably on a piece for the adjustment to the pile height to be woven and the lifting height of the binding warp threads.

The invention also relates to a face-to-face weaving machine provided with a device according to the invention, for the purpose of obtaining virtually the same, and preferably the same, binding warp thread tension in the bottom and top binding warp yarns. In particular, said weaving machine has three grippers lying one above another.

The invention also relates to a structure consisting of a top or first fabric and a bottom or second fabric which can be produced by a machine provided with a device according to the invention.

This fabric (top or bottom) has the same constant tension in binding warp threads.

DETAILED DESCRIPTION OF THE INVENTION

Figure 1:
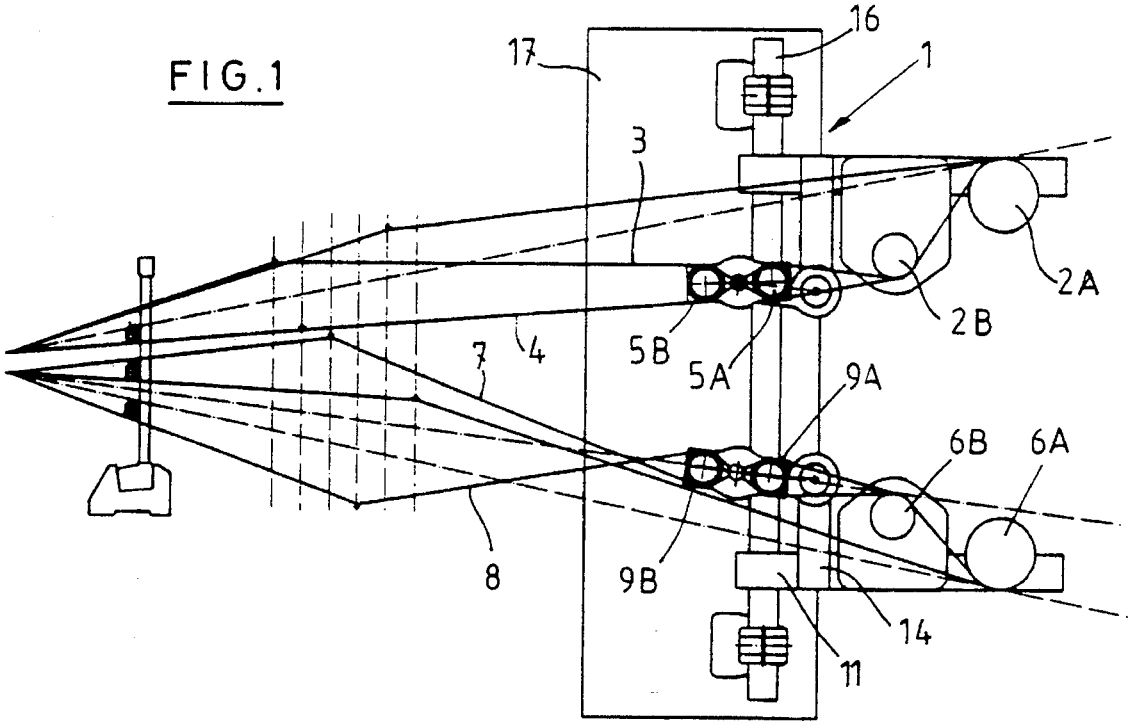
FIG. 1 shows a device according to the invention in a face-to-face weaving machine during the insertion of one weft thread.
Figure 3:
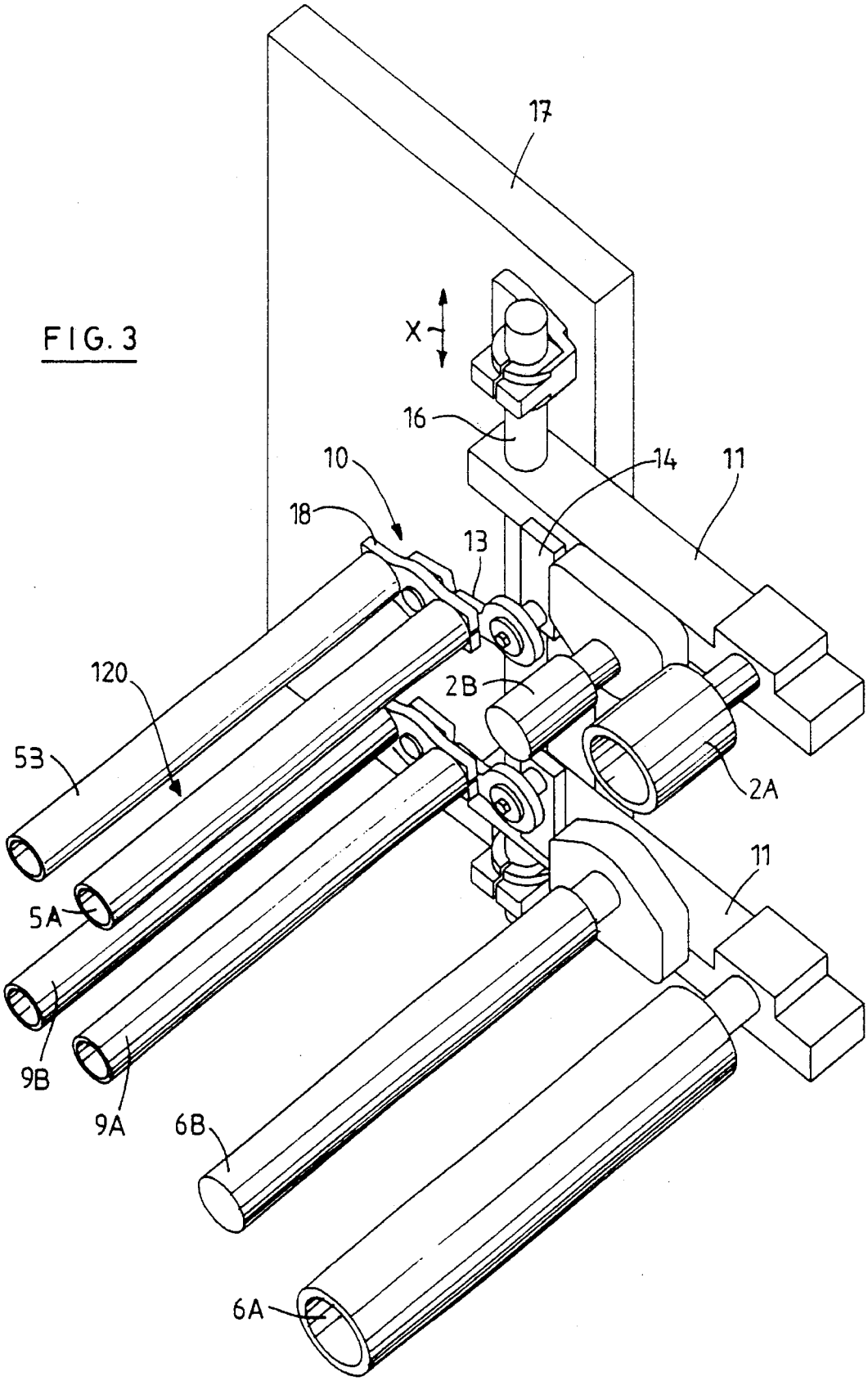
FIG. 3 shows a perspective view of the device of FIG. 1.

Referring to FIGS. 1 and 3, the device comprises a first set of separating rollers 2A and 2B, and a second set of separating rollers 5A and 5B. The separating rollers 2A and 2B separate a plurality of first binding warp threads 3 and 4 from first tension warp threads. The second set of separating rollers 5A and 5B is for causing the binding warp threads 3 and 4 to cross each other between the second set of separating rollers 5A and 5B. Rollers 2A, 2B, 5A and 5B are positioned for forming a top or first fabric.

The device also comprises a third set of separating rollers 6A and 6B, structurally similar to the first set of rollers 2A and 2B, for separating second binding warp threads 7 and 8 from second tension warp threads.

The device further comprises a fourth set of separating rollers 9A and 9B, structurally similar to the second set of rollers 5A and 5B, for causing the separated second binding warp threads 7 and 8 to cross each other between the fourth set of separating rollers 9A and 9B.

In operation, the device enables the first binding warp threads 3 and 4 in the first fabric to attain substantially the same tension as the second binding warp threads 7 and 8 in the second fabric.

Figure 2:
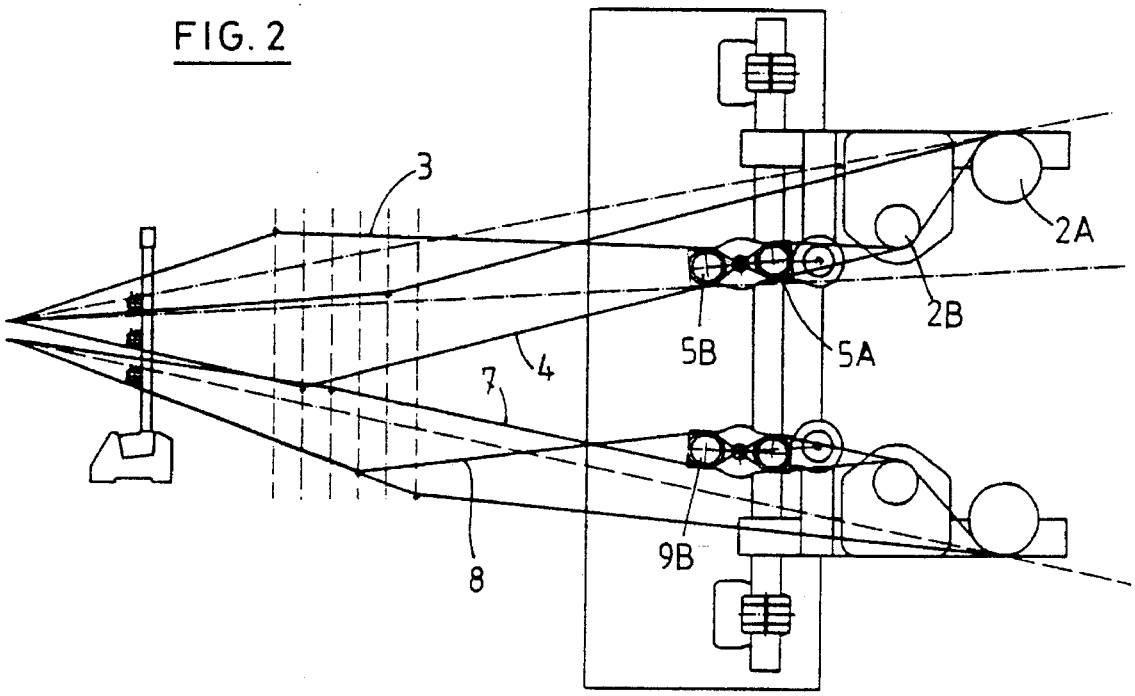
FIG. 2 shows the device of FIG. 1 in a face-to-face weaving machine during the insertion of two weft threads.

Referring to FIGS. 1–3, the second set of separating rollers 5A and 5B for the first fabric, and the fourth set of separating rollers 9A and 9B for the second fabric are mounted on a system 10 which is rotatable relative to a holder 11. The holder 11 bears the first set of separating rollers 2A and 2B for the first fabric, and the third set of separating rollers 6A and 6B for the second fabric.

Referring to FIG. 3, the system 10 comprises an element or a spacer 18 on which either the first set of separating rollers 5A and 5B or the third set of separating rollers 9A and 9B are rotatably or otherwise fixed. The spacer 18 has a center point for being rotatably connected to a connecting rod 13. The system 10 also has a connecting piece 14 on which the connecting rod 13 is rotatably connected, and a common holder 11 of the second set of separating rollers 5A and 5B and the fourth set of separating rollers 9A and 9B. The common holder 11 can be secured to a bar 16 for adjusting the pile height to be woven and the lifting height of the ground warp threads.

Each end of the second set of separating rollers 5A and 5B, and of the fourth set of separating rollers 9A and 9B, is preferably fixed to an assigned spacer 18. The positioning of the second set of separating rollers 5A and 5B, and the fourth set of separating rollers 9A and 9B, forms a respective lease rod 120. The first binding warp threads 3 and 4 cross each other between the rollers 5A and 5B in the second set. The second binding warp threads 7 and 8 cross each other between the rollers 9A and 9B in the fourth set.

Referring to FIG. 3, the common holder 11 of the first and third set of rollers can be adjusted along an axis X relative to a bar 16, in order to adjust the pile height. The bar 16 is fixed to the frame 17 of the device.

Due to the fact that the connecting rods 13 are rotatably fixed to a connecting piece 14, the lease rods 120 can swing jointly towards the variable bisector plane V of the binding warp thread planes under the influence of a pulling force of the binding warp threads for each successive position of the binding warp threads. The difference in length between the top or first and bottom or second binding warp thread layers is taken up by rotation of the lease rods 120 about the center point between them on the spacer 18, which is rotatable on the connecting rod 13. In this way the same binding warp thread tension is obtained in the first and the second binding warp thread layer.

Figure 4:
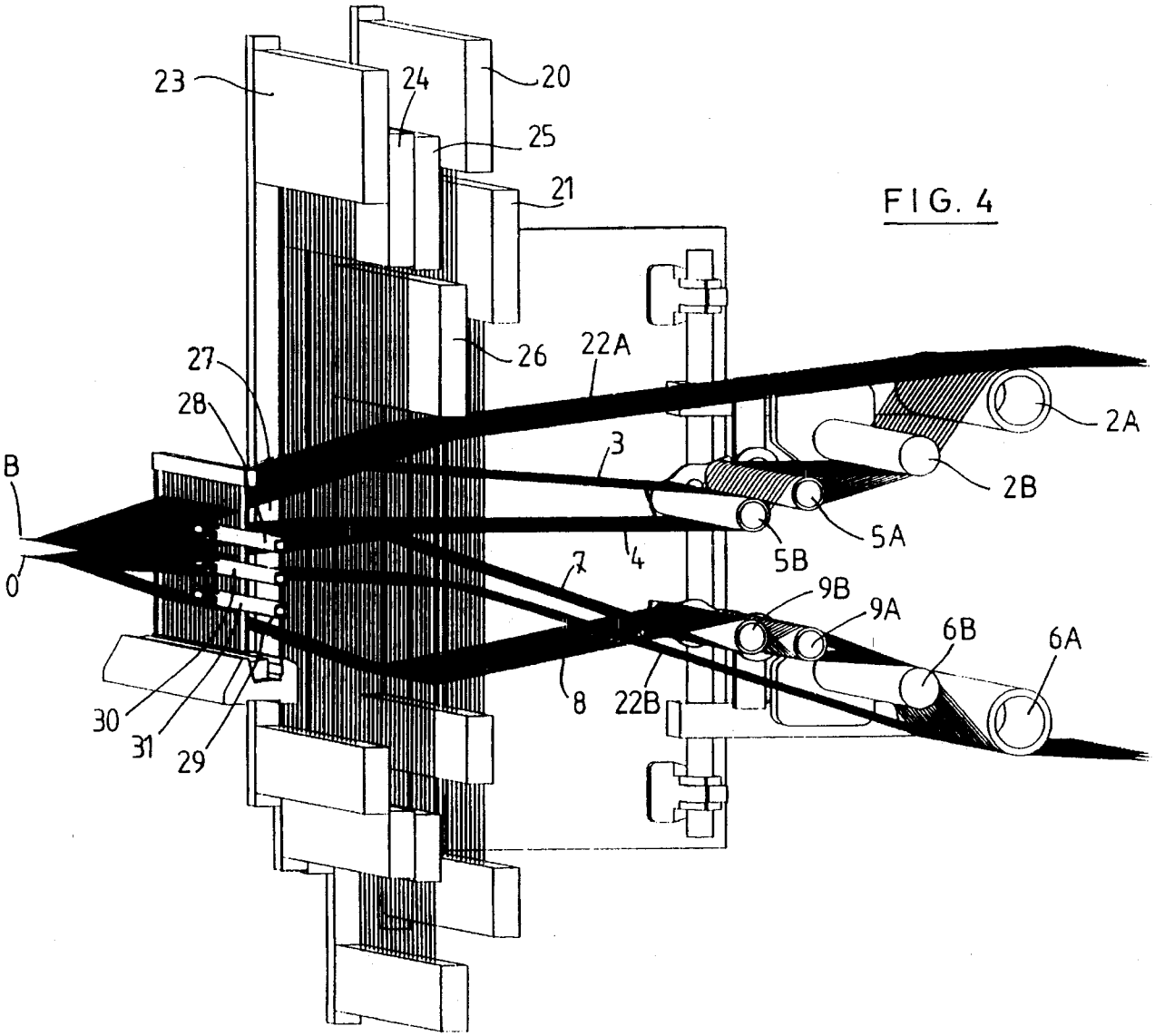
FIG. 4 shows a perspective view of FIG. 1.

Referring to FIGS. 4, the inventive device enables one to weave with three grippers 28, 30 and 31. The grippers 28, 30 and 31 are positioned in a generally vertical configuration. With this configuration, different binding warp sheds are formed in the successive weft insertion cycles.

FIG. 4 shows the ground warp thread course in the case of a first shot of a face-to-face weaving machine with three grippers.

FIGS. 1 and 4 show the inventive device operating in conjunction with a weaving machine. Shed-forming means or weaving frames 20 and 21 force the tension warp threads 22A and 22B into the required position for forming the weaving shed. Weaving frames 23, 24, 25, and 26, force the binding warp threads of the first fabric and the second fabric, respectively, into the required position for forming the weaving shed for simultaneous weft insertion into three sheds.

In FIG. 4 the shed 27 between binding warp threads 3 and 4 of the first fabric B is presented for a single insertion of a weft thread with gripper rod 28, while the shed 29 of the second fabric O is presented for double weft insertion with gripper rods 30 and 31.

Figure 5:
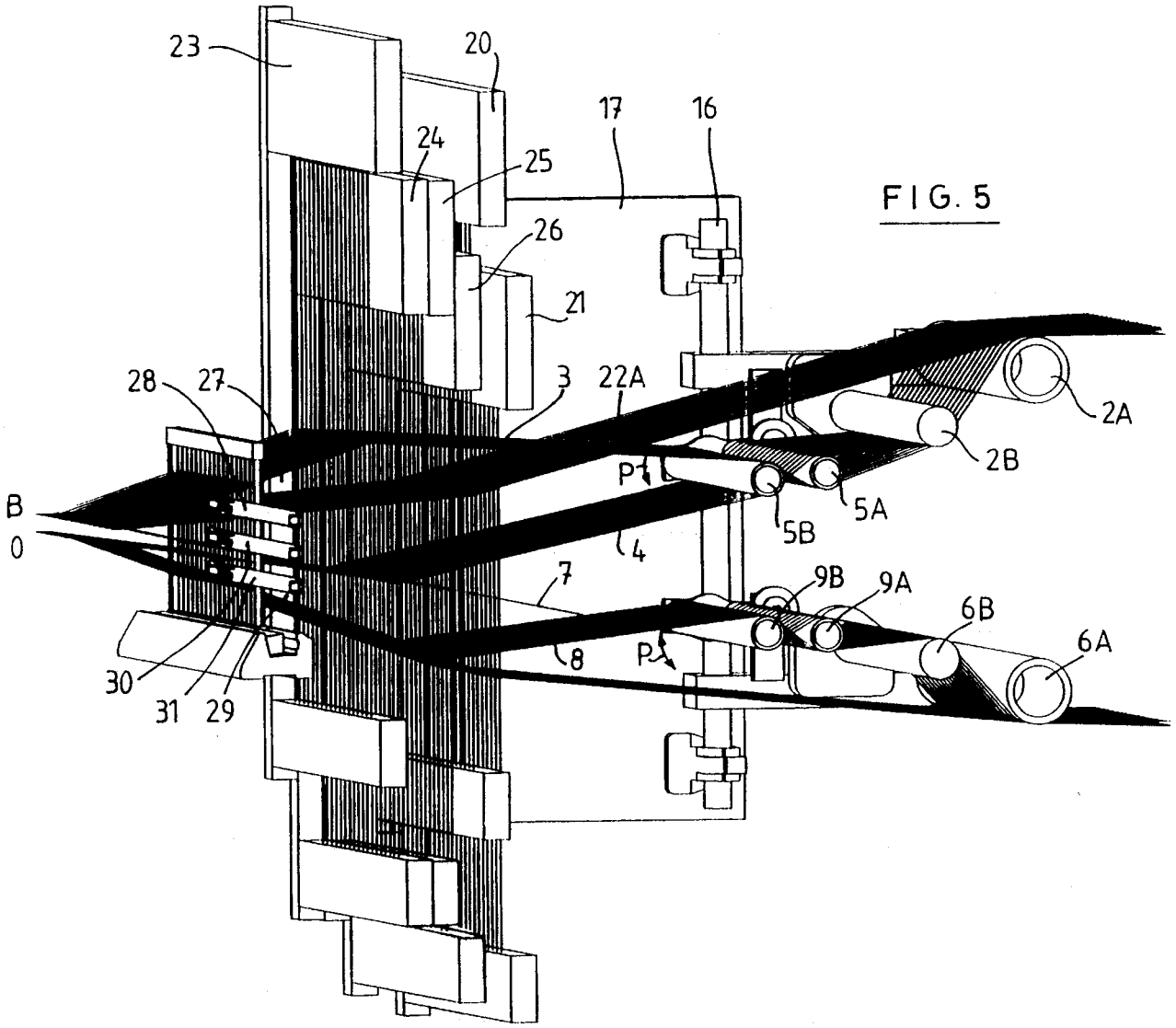
FIG. 5 shows a perspective view of FIG. 2.

In FIG. 5 (second shot) the shed 27 is presented for a double weft insertion with gripper rods 28, 30, while the shed 29 is presented for a single weft insertion.

Between shot 1 and shot 2 for the first fabric B, the weaving frame 20 moves downward (movement of tension warp threads 22 downwards) and the weaving frame 24 moves downwards in order to increase the shed 27 in such a way that two weft threads can be inserted with gripper rods 28, 30.

The binding warp threads 4 are thus pulled downwards, while the set of lease rods 120 swivel towards the bisector plane and pivot about their center point. This action reduces the difference in length between first and second binding warp thread layers.

We claim:

1. A device for use in a face-to-face weaving machine for weaving at least a first fabric and a second fabric to be linked to each other, said first fabric including at least a plurality of first binding warp threads and first tension warp threads, said second fabric including at least a plurality of second binding warp threads and second tension warp threads, said device comprising:

a first set of rollers for separating said first binding warp threads from said first tension warp threads;

a second set of rollers for causing the separated first binding warp threads to cross each other between the rollers in the second set;

a third set of rollers for separating said second binding warp threads from said second tension warp threads;

a fourth set of rollers for causing the separated second binding warp threads to cross each other between the rollers in the fourth set;

whereby the first binding warp threads in said first fabric attain substantially the same tension as the second binding warp threads in said second fabric.

2. The device according to claim 1 and further comprising a holder bearing the first set of rollers and an arm provided with an element bearing the second set of rollers, said arm being rotatably mounted on said holder.

3. The device according to claim 2, wherein said second set of rollers includes two rollers and said element is mounted on said arm for rotation about an axis extending between the two rollers in the second set.

4. The device according to claim 3, wherein said axis is centered between the two rollers in the second set.

5. The device according to claim 2, wherein said holder is adapted to be adjustably mounted on a piece for adjustment of a position of said first binding warp threads so as to vary a pile height to be woven and a lifting height.

6. A face-to-face weaving machine comprising:

means for weaving at least a first fabric and a second fabric to be linked to each other, said first fabric including at least a plurality of binding warp threads and tension warp threads;

a device comprising:

a first set of rollers for separating said binding warp threads from said tension warp threads; and a second set of rollers for causing the separated binding warp threads to cross each other between the rollers in the second set;

whereby the binding warp threads in said first fabric attain substantially the same tension.

7. The weaving machine according to claim 6 further comprising at least three grippers each for inserting weft threads through selected sheds between the binding warp threads, said at least three grippers lying one above another.

* * * * *